US011402864B2

(12) United States Patent
Berglar

(10) Patent No.: US 11,402,864 B2
(45) Date of Patent: Aug. 2, 2022

(54) PEDAL FOR A VEHICLE

(71) Applicant: Hella GmbH & Co. KGaA, Lippstadt (DE)

(72) Inventor: Heinrich Berglar, Lippetal (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/763,096

(22) PCT Filed: Nov. 16, 2017

(86) PCT No.: PCT/EP2017/079428
§ 371 (c)(1),
(2) Date: May 11, 2020

(87) PCT Pub. No.: WO2019/096387
PCT Pub. Date: May 23, 2019

(65) Prior Publication Data

US 2020/0363830 A1 Nov. 19, 2020

(51) Int. Cl.
*G05G 1/44* (2008.04)
*G05G 5/03* (2008.04)

(52) U.S. Cl.
CPC ..... *G05G 1/44* (2013.01); *G05G 5/03* (2013.01)

(58) Field of Classification Search
CPC ..... G05G 1/44
See application file for complete search history.

(56) References Cited

U.S. PATENT DOCUMENTS 6,289,762 B1 * 9/2001 Silva ..... G05G 1/38 74/513
7,926,384 B2 * 4/2011 Wurn ..... G05G 1/38 74/513
2004/0237700 A1 12/2004 Wurn
2007/0137400 A1 * 6/2007 Campbell ..... G05G 1/38 74/513
2008/0276750 A1 * 11/2008 Kim ..... G05G 1/38 74/513

FOREIGN PATENT DOCUMENTS

EP 974886 A2 1/2000
WO 2007053713 A2 5/2007
WO 2018039098 A1 3/2018

* cited by examiner

*Primary Examiner* — Vicky A Johnson
(74) *Attorney, Agent, or Firm* — Husch Blackwell LLP

(57) ABSTRACT

A pedal for a vehicle is provided, which includes a support, a pedal arm mounted to the support, and a rocker mounted to the support. The rocker comprises a first rocker arm and a second rocker arm. The pedal also includes a return spring. The pedal is built in such a manner that when the second rocker arm is pressed with a friction section against a friction surface of the pedal arm, when the pedal arm is forced into a direction of the maximum deflection position of the pedal arm. In order to provide a pedal for a vehicle of alternative design, the pedal arm, the rocker and the return spring are built and positioned to each other in such a manner that an external actuating force is continuously and steadily increasing in a first section of an actuating path and is continuously and steadily decreasing in a second section of the actuating path until a predefined deflection position is reached.

10 Claims, 2 Drawing Sheets

PEDAL FOR A VEHICLE

CROSS REFERENCE

This application claims priority to PCT Application No. PCT/EP2017/079428, filed Nov. 16, 2017, the entirety of which is hereby incorporated by reference.

FIELD OF THE INVENTION

The present invention relates to a pedal for a vehicle.

BACKGROUND

Pedals for vehicles are already known in different embodiments.

From the DE 43 00 096 C2 a pedal for a vehicle is known. Said known pedal comprises a support, a pedal arm mounted to said support and pivotable around a solid pivot axis for said pedal arm between an idle position and a maximum deflection position of said pedal arm, a rocker mounted to said support and pivotable around a solid pivot axis for said rocker, whereat said rocker comprises a central part pivotably mounted to said support and a first rocker arm and a second rocker arm, which are located on opposite sides of said central part. Said known pedal further comprises a return spring for forcing said pedal arm into a direction of said idle position of said pedal arm, whereat said pedal arm and said first rocker arm are linked by said return spring in a power transmitting manner. Said known pedal is built in such a manner, that said second rocker arm is being pressed with a friction section against a friction surface of said pedal arm, if said pedal arm is forced via an external actuating force into a direction of said maximum deflection position of said pedal arm.

It is an object of the invention to provide a pedal for a vehicle of alternative design.

SUMMARY OF THE INVENTION

This object of the invention is solved by a pedal for a vehicle according to claim 1, wherein said pedal arm, said rocker and said return spring are built and positioned to each other in such a manner, that said external actuating force necessary to transfer said pedal arm from said idle position to said maximum deflection position along an actuating path is continuously and steadily increasing in a first section of said actuating path and is continuously and steadily decreasing in a second section of said actuating path, until a predefined deflection position is reached. Thus, after said predefined deflection position is reached, it is possible that said actuating path does not end but does continue and said actuating force is further decreasing, is again increasing or does not change substantially.

A main advantage of the pedal for a vehicle according to the invention is, that besides a high flexible pedal design because of the flexibility of the built and the arrangement of said pedal arm, said rocker and said return spring, said external activating force needed for pressing said pedal arm of said pedal is reduced in said second section of said actuating path while said pedal arm is transferred from said idle position of said pedal arm to said maximum deflection position of said pedal arm. Thus, the handling of said pedal for a vehicle according to the invention is more comfortable. Preferably, said maximum of said actuating path, namely the end of said first section and the beginning of said second section of said actuating path, is reached after approximately ⅔ of said actuating path. Thus, said external actuating force is continuously and steadily decreasing in the last ⅓ of said actuating path of said pedal arm.

The wordings solid pivot axis for said pedal arm and solid pivot axis for said rocker are quite general and mean that said pivot axes are material and not virtual.

Moreover, the wording continuously and steadily means, that said external actuating force is increasing in said first section and decreasing in said second section without having peaks, bumps or another sudden change of said external actuating force. Thus, said external actuating force is increasing in said first section of said actuating path and is decreasing in said second section of said actuating path in a smoothly manner.

Further advantageous developments of the inventive pedal for a vehicle are apparent from the sub-claims as well as from the following description of exemplary embodiments of the pedal for a vehicle according to the invention by means of the attached Figures.

A further advantageous development of the inventive pedal for a vehicle is, that said pedal arm, said rocker and said return spring are built and positioned to each other in such a manner, that a transition of said pedal arm from said first section to said second section of said actuating path is accompanied by a steady transition of said external actuating force from continuously and steadily increasing to continuously and steadily decreasing. That way, the handling of said pedal according to the invention is even more comfortable.

Basically, the arrangement of said rocker relative to said pedal arm can be of any suitable kind. Favorably, said rocker encompasses a mounting end of said pedal arm being pivotable mounted to said solid pivot axis for said pedal arm, at least partly. Hereby, it is possible to create a quite large contact area between said friction section of said second rocker arm of said rocker and said friction surface of said pedal arm corresponding to said friction section.

A particular preferable development of the pedal according to the aforementioned embodiment is, that said second rocker arm substantially encompasses said mounting end of said pedal arm and said first rocker arm is extended in an area of said pedal arm, which is following said mounting end. Hereby, on the one hand, a firm contact between said friction section of said second rocker arm of said rocker and said friction surface of said pedal arm corresponding to each other is established, while on the other hand, sufficient space is left for even a major movement of said rocker relative to said pedal arm.

An advantageous development of the inventive pedal according to the embodiment last-mentioned is, that said first rocker arm is longer than said second rocker arm. That way, the lever of said first rocker arm relative to said second rocker arm enables to press said pedal arm with less external actuating force, thus with more comfort.

A further advantageous development of the inventive pedal for a vehicle according to the invention is, that said solid pivot axis for said rocker is positioned between said return spring and said solid pivot axis for said pedal arm. Hereby, it is possible to keep the overall design of the inventive pedal for a vehicle more compact.

A favorable development of the pedal according to the aforementioned embodiment not referred to claim 5 is, that said second rocker arm is longer than said first rocker arm. Thus, the overall design of the inventive pedal for a vehicle is even more compact.

A particular preferable development of the inventive pedal for a vehicle is, that said friction section of said second rocker arm or said friction surface of said pedal arm is built as a slide guide with a predefined contour for a corresponding sliding part, namely said friction surface or said friction section. That way, it is possible to create the inventive pedal by using a quite simple design. Furthermore, it is quite easy to design a certain relationship between said external actuating force said pedal arm is actuated with and said deflection position of said pedal arm due to said external actuating force.

Another favorable development of the inventive pedal for a vehicle is, that said friction section of said second rocker arm and said friction surface of said pedal arm are built as wedge-shaped parts corresponding to each other. Hereby, it is possible to achieve more friction between said friction section of said second rocker arm and said friction surface of said pedal arm.

In general, said return spring can be of any shape, material, dimension and position relative to said pedal arm and said rocker. Favorably, said return spring is a single helical spring or a double helical spring. Thus, the freedom of design of said pedal arm but also of said rocker is improved. Furthermore, helical springs are available in a lot of different embodiments usable for quite different applications.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
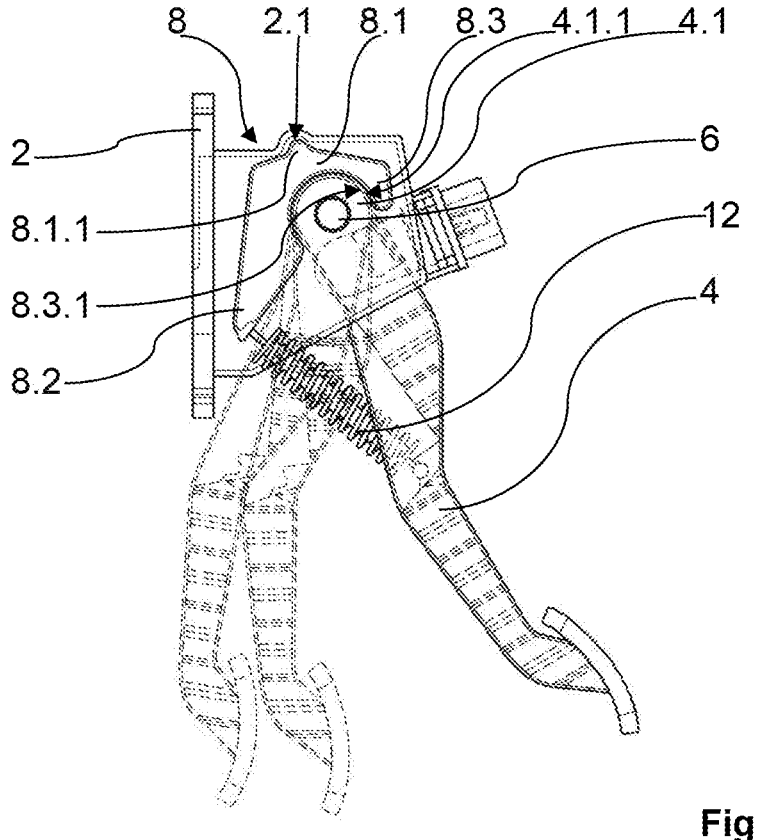
FIG. 1 is a first embodiment of a pedal for a vehicle according to the invention in a sectional side view, with the pedal arm displayed in an idle position, an intermediate position and in a maximum deflection position.

FIG. 1 displays a first embodiment of a pedal for a vehicle according to the invention designed as a clutch pedal, comprising a support 2, a pedal arm 4 mounted to said support 2 via a mounting end 4.1 and pivotable around a solid pivot axis 6 for said pedal arm 4 between an idle position and a maximum deflection position of said pedal arm 4. In FIG. 1 said pedal arm 4 is displayed in said idle position of said pedal arm 4, in an intermediate position of said pedal arm 4 and in said maximum deflection position of said pedal arm 4. Said idle position is shown on the right side of FIG. 1, said intermediate position is shown in the middle of FIG. 1 and said maximum deflection position is shown on the left side of FIG. 1.

Said first embodiment further comprises a rocker 8 mounted to said support 2 and pivotable around a solid pivot axis 2.1 for said rocker 8, whereat said rocker 8 comprises a central part 8.1 pivotably mounted to said support 2 and a first rocker arm 8.2 and a second rocker arm 8.3, which are located on opposite sides of said central part 8.1, as well as a return spring 12 for forcing said pedal arm 4 into a direction of said idle position of said pedal arm 4, whereat said return spring 12 is linked to said pedal arm 4 and said first rocker arm 8.2 in a power transmitting manner. Thus, said pedal arm 4 and said first rocker arm 8.2 are linked by said return spring 12 in a power transmitting manner. Said solid pivot axis 6 for said pedal arm 4 is built as a rigid bolt 6. Said solid pivot axis 2.1 for said rocker 8 is built as a notch 2.1 of said support 2 receiving a projection 8.1.1 of said central part 8.1 of said rocker 8.

Said rocker 8 encompasses a mounting end 4.1 of said pedal arm 4 being pivotable mounted to said solid pivot axis 6 for said pedal arm 4, at least partly, namely said second rocker arm 8.3 substantially encompasses said mounting end 4.1 of said pedal arm 4 and said first rocker arm 8.2 is extended in an area of said pedal arm 4, which is following said mounting end 4.1. Thus, said first rocker arm 8.2 extends from said central part 8.1 of said rocker 8 at the upper side to the lower side, with respect to the image plane of FIG. 1. That way, said first rocker arm 8.2 is longer than said second rocker arm 8.3 of said rocker 8.

Said solid pivot axis 6 for said pedal arm 4 and said solid pivot axis 2.1 for said rocker 8 are in parallel to each other and said solid pivot axes 6 of said pedal arm 4 and 2.1 of said rocker 8 run perpendicular to a plane defined by power transmission axes of said return spring 12, while said pedal arm 4 is in said idle position of said pedal arm 4 and while said pedal arm 4 is in said maximum deflection position of said pedal arm 4. Said power transmission axes are not displayed. Said pedal arm 4, said rocker 8 and said return spring 12 are built and positioned to each other in such a manner, that an external actuating force necessary to transfer said pedal arm 4 from said idle position of said pedal arm 4 to said maximum deflection position of said pedal arm 4 along an actuating path is continuously and steadily increasing in a first section of said actuating path and is continuously and steadily decreasing in a second section of said actuating path, until a predefined deflection position is reached.

Figure 2:
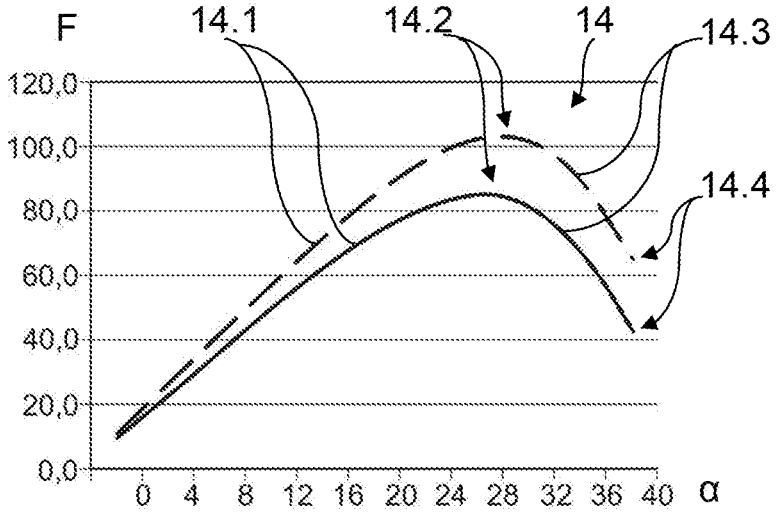
FIG. 2 is a force/deflection graph of the pedal for a vehicle according to said first embodiment displaying the characteristic of said pedal.

This can be seen best in FIG. 2, which displays a force/deflection graph corresponding to the first embodiment of the inventive pedal for a vehicle. FIG. 2 is not only used to explain the function of said first embodiment but is also used to explain the second exemplary embodiment as well as other possible embodiments covered by the invention. The force/deflection graph displayed in FIG. 2 shows two lines, one solid line and one broken line, which correspond to the first embodiment of the invention according to FIG. 1. Nevertheless, it is possible to explain the force/deflection graph corresponding to the second embodiment with FIG. 2, too.

Said force/deflection graph, with a deflection angle $\alpha$ of said pedal arm 4 on a horizontal axis of said graph and with said external actuating force F of said pedal arm 4 on a vertical axis of said graph, with said two lines each displaying said first section 14.1 of said actuating path 14, in which said external actuating force F of said pedal arm 4 is ascending to a maximum 14.2 of said actuating force F of said pedal arm 4 in a continuous and steady manner and subsequent to said first section 14.1 displaying a second section 14.3 of said actuating path 14, in which said external actuating force F of said pedal arm 4 is descending again in a continuous and steady manner, until said maximum deflection position of said pedal arm 4 is reached. The deflection angle $\alpha=0°$ corresponds to said idle position of said pedal arm 4 and the deflection angle $\alpha=40°$ corresponds to said maximum deflection position of said pedal arm 4. Said two lines in FIG. 2 are just examples for a variety of possible force/deflection relationships which can be realized by using the pedal for a vehicle according to the invention. Because of the flexibility of the built and the position to each other of said pedal arm, said rocker and said return spring, the inventive pedal for a vehicle is usable for a lot of different requirements.

Furthermore, it can be seen from FIG. 2 that said pedal arm 4, said rocker 8 and said return spring 12 are built and positioned to each other in such a manner, that a transition of said pedal arm 4 from said first section 14.1 to said second section 14.3 of said actuating path 14 is accompanied by a steady transition of said external actuating force F from continuously and steadily increasing to continuously and steadily decreasing. Thus, the transition from said first section 14.1 to said second section 14.3 is comfortable and does not cause trouble to a driver of said vehicle equipped with the pedal according to the invention. Said maximum of said external actuating force F is reaches at about $\alpha=30°$; thus, said external actuating force F is continuously and steadily decreasing after about ⅔ of said actuating path 14. This is true for both lines in FIG. 2.

In said first embodiment, said return spring 12 is designed as a single helical spring 12. Furthermore, said return spring 12 is linked to said pedal arm 4 and said first rocker arm 8.2 of said rocker 8 by pivot axes of said return spring 12 parallel to said pivot axis 6 of said pedal arm 4. Said pivot axes of said return spring 12 are not displayed. Thus, said power transmission axis of said return spring 12 is kept straight because of said pivot axes of said return spring 12.

In the following, the function of said first embodiment of a pedal for a vehicle according to the invention is explained by means of FIGS. 1 and 2.

A user of said clutch pedal, namely a driver of said vehicle comprising said clutch pedal, presses down said pedal arm 4 of said clutch pedal with a foot, thus loading said pedal arm 4 with an external actuating force F in order to transfer said pedal arm 4 from said idle position of said pedal arm 4 displayed in FIG. 1 to said maximum deflection position of said pedal arm 4 displayed in FIG. 1.

Said power transmitting link between said pedal arm 4 and said first rocker arm 8.2 of said rocker 8, namely said return spring 12, as well as said solid pivot axes 6 of said pedal arm 4 and 2.1 of said rocker 8 are designed, configured and positioned to each other to provide a force/deflection graph of said pedal arm 4 pressed to transfer said pedal arm 4 from said idle position of said pedal arm 4 to said maximum deflection position of said pedal arm 4 as shown in FIG. 2. Because of said power transmitting link between said pedal arm 4 and said first rocker arm 8.2 via said return spring 12, said second rocker arm 8.3 is being pressed with a friction section 8.3.1 against a friction surface 4.1.1 of said mounting end 4.1 of said pedal arm 4, while said pedal arm 4 is forced into a direction of said maximum deflection position of said pedal arm 4 by pressing said pedal arm 4 with said external actuating force F.

During release of said pedal arm 4, namely while said driver of said vehicle is not pressing said pedal arm 4, said return spring 12 forces said pedal arm 4 from said maximum deflection position of said pedal arm 4 back to said idle position of said pedal arm 4.

Figure 3:
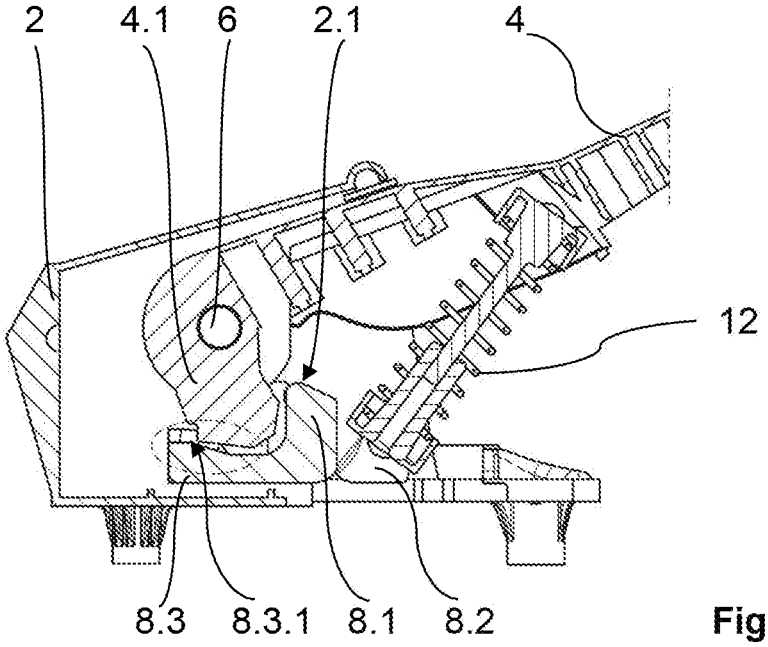
FIG. 3 is a second embodiment of a pedal for a vehicle according to the invention in a sectional side view, with the pedal arm displayed in an idle position, only partly displayed.
Figure 5:
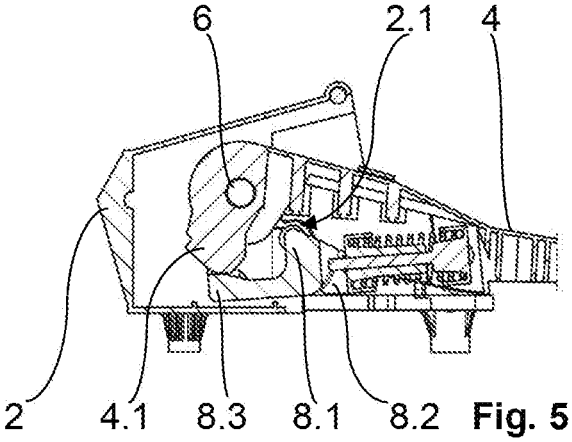
FIG. 5 is another sectional side view of said second embodiment according to FIG. 3, with said pedal arm shown in a maximum deflection position, only partly displayed.
Figure 4:
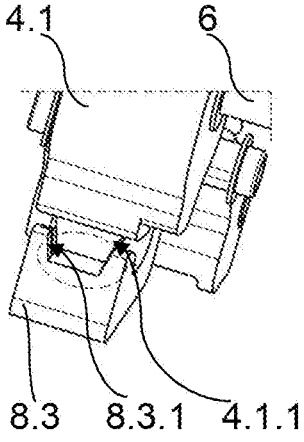
FIG. 4 is a detail of said second embodiment according to FIG. 3 in the area of the friction section of the rocker and the friction surface of said pedal arm, in a perspective view from the front of said pedal.

In FIGS. 3 to 5 a second embodiment of a pedal for a vehicle according to the invention is displayed. In FIG. 3 said pedal arm 4 is displayed in said idle position of said pedal arm 4, whereas FIG. 5 shows said maximum deflection position of said pedal arm 4. In comparison to said first embodiment displayed in FIG. 1 said solid pivot axis 2.1 for said rocker 8 of said second embodiment is positioned between said return spring 12 and said solid pivot axis 6 for said pedal arm 4. Said solid pivot axis 2.1 for said rocker 8 is built as a rigid bolt like said solid pivot axis 6 of said pedal arm 4. Furthermore, said second rocker arm 8.3 is longer than said first rocker arm 8.2 as can be seen best from FIG. 3.

A further difference to said first embodiment is, that said friction section 8.3.1 of said second rocker arm 8.3 of said rocker 8 is built as a slide guide with a predefined contour 8.3.1 for said friction surface 4.1.1 of said mounting end 4.1 of said pedal arm 4. Thus, said friction surface 4.1.1 of said mounting end 4.1 is built as a sliding part 4.1.1 corresponding to said slide guide 8.3.1. That way, it is possible to create the inventive pedal by using a quite simple design. Furthermore, it is quite easy to design a certain relationship between said external actuating force F said pedal arm 4 is actuated with and said deflection position a of said pedal arm 4 due to said external actuating force F.

Moreover, said friction section 8.3.1 of said second rocker arm 8.3 of said rocker 8 and said friction surface 4.1.1 of said mounting end 4.1 of said pedal arm 4 are built as wedge-shaped parts 8.3.1, 4.1.1 corresponding to each other. This can be seen best from FIG. 4. Thus, said friction section 8.3.1 of said second rocker 8.3 is built by wedge-shaped side walls of said second rocker arm 8.3 of said rocker 8 and said friction surface 4.1.1 of said mounting end 4.1 is built by wedge-shaped side walls of said mounting end 4.1 of said pedal arm 4. By designing said friction section 8.3.1 of said second rocker arm 8.3 of said rocker 8 as a slide guide 8.3.1 for said friction surface 4.1.1 of said mounting end 4.1 of said pedal arm 4, it is possible to modify the friction/deflection relationship as displayed in FIG. 2 quite easily. Thus, the pedal for a vehicle according to the invention can be used for a lot of different applications without leaving the basic design.

The invention is not limited to the exemplary embodiments discussed before.

Of course, the invention is not limited to clutch pedals, but can be used in an advantage manner for other pedals for a vehicle, too.

The force/deflection graph as shown in FIG. 2 is also exemplary. Thus, in other embodiments, after said predefined deflection position is reached, it is possible that said actuating path does not end but does continue and said external actuating force is further decreasing, is again increasing or does not change substantially.

Furthermore, said return spring is not limited to single helical springs, but can be of any useful and applicable type. For example, said return spring could also be a double helical spring. Said return spring can be realized as a combined element, too. E.g., it would be possible to merge a rigid cam or rigid rod with a spring or different types of springs in a combined element.

The pedal for a vehicle according to the invention is highly flexible and thus can be used in and advantageous way satisfying a lot of different requirements and specifications for a pedal for a vehicle.

LIST OF REFERENCE NUMBERS

2 Support
2.1 Solid pivot axis for rocker 8
4 Pedal arm

4.1 Mounting end of pedal arm 4
4.1.1 Friction surface of mounting end 4.1
6 Solid pivot axis for pedal arm 4
8 Rocker
8.1 Central part of rocker 8
8.1.1 Projection of central part of rocker 8.1
8.2 First rocker arm of rocker 8
8.3 Second rocker arm of rocker 8
8.3.1 Friction section of second rocker arm 8.3
12 Return spring
14 Actuating path
14.1 First section of actuating path 14
14.2 Maximum of external actuating force F in actuating path 14
14.3 Second section of actuating path 14
14.4 Predefined deflection position of the pedal arm 4 at the end of second section 14.3

The invention claimed is:

1. A pedal for a vehicle, the pedal comprising:

a support, a pedal arm mounted to said support and pivotable around a solid pivot axis for said pedal arm between an idle position and a maximum deflection position of said pedal arm, said pedal arm including a proximal end and a distal end, said proximal end of said pedal arm including a friction surface, a rocker mounted to said support and pivotable around a solid pivot axis for said rocker, wherein said rocker comprises:

a central part pivotably mounted to said support, a first rocker arm and a second rocker arm, which are located on opposite sides of said central part, said second rocker arm including a friction section, and a return spring for forcing said pedal arm into a direction of said idle position of said pedal arm, wherein said pedal arm and said first rocker arm are linked by said return spring in a power transmitting manner, wherein said return spring is positioned between said pedal arm and said first rocker arm, and said return spring is linked to said pedal arm at a location between said solid pivot axis for said pedal arm and said distal end, wherein said friction section of said second rocker arm is pressed against said friction surface of said pedal arm when said pedal arm is forced via said external actuating force into a direction of said maximum deflection position of said pedal arm, wherein both said first rocker arm and said second rocker arm directly abut said pedal arm when said pedal arm is in said idle position, and wherein said external actuating force necessary to transfer said pedal arm from said idle position to said maximum deflection position along an actuating path is continuously and steadily increasing in a first section of said actuating path and is continuously and steadily decreasing in a second section of said actuating path, until a predefined deflection position is reached.

2. The pedal according to claim 1, wherein a transition of said pedal arm from said first section to said second section of said actuating path is accompanied by a steady transition of said external actuating force from continuously and steadily increasing to continuously and steadily decreasing.

3. The pedal according to claim 1, wherein said rocker encompasses a mounting end of said pedal arm being pivotable mounted to said solid pivot axis for said pedal arm, at least partly.

4. The pedal according to claim 3, wherein said second rocker arm substantially encompasses said mounting end of said pedal arm and said first rocker arm is extended in an area of said pedal arm, which is following said mounting end.

5. The pedal according to claim 4, wherein said first rocker arm is longer than said second rocker arm.

6. The pedal according to claim 1, wherein said solid pivot axis for said rocker is positioned between said return spring and said solid pivot axis for said pedal arm.

7. The pedal according to claim 6, wherein said second rocker arm is longer than said first rocker arm.

8. The pedal according to claim 1, wherein said friction section of said second rocker arm or said friction surface of said pedal arm is built as a slide guide with a predefined contour for a corresponding sliding part, namely said friction surface or said friction section.

9. The pedal according to claim 1, wherein said friction section of said second rocker arm and said friction surface of said pedal arm are built as wedge-shaped parts corresponding to each other.

10. The pedal according to claim 1, wherein said return spring is a single helical spring or a double helical spring.

* * * * *